US007895922B2

(12) United States Patent
Hung

(10) Patent No.: US 7,895,922 B2
(45) Date of Patent: Mar. 1, 2011

(54) RATCHET WRENCH

(76) Inventor: Wen-Ding Hung, Fongshan (TW)

( * ) Notice: Subject to any disclaimer, the term of this patent is extended or adjusted under 35 U.S.C. 154(b) by 21 days.

(21) Appl. No.: 12/426,969

(22) Filed: Apr. 21, 2009

(65) Prior Publication Data

US 2010/0263496 A1 Oct. 21, 2010

(51) Int. Cl.
*B25B 13/46* (2006.01)

(52) U.S. Cl. ..... 81/63.1

(58) Field of Classification Search ..... 81/60–63.2
See application file for complete search history.

(56) References Cited

U.S. PATENT DOCUMENTS 6,912,935 B2 * 7/2005 Hsien ..... 81/63.2
6,971,285 B2 * 12/2005 Chen ..... 81/63.1
6,981,434 B2 * 1/2006 Chen ..... 81/63.1
7,089,830 B2 * 8/2006 Hu ..... 81/63.1

* cited by examiner

*Primary Examiner*—Hadi Shakeri
(74) *Attorney, Agent, or Firm*—Leong C. Lei

(57) ABSTRACT

A ratchet wrench includes a body, a ratchet wheel, a control unit, and a rotary knob. The body has an end forming a ratchet wheel bore and a receiving hole, which respectively and rotatably receive the ratchet wheel and the rotary knob therein. A channel is defined in the body between the ratchet wheel bore and the receiving hole for receiving therein the control unit. The control unit includes two detent blocks and a spring. The detent blocks are selectively engageable with teeth formed in the ratchet wheel. The rotary knob retains a control bar and a positioning ball. The receiving hole has an inner circumferential wall in which two positioning notches are defined. The control bar is operated to move the detent blocks to desired positions and the positioning ball is biased by a spring into selective engagement with the positioning notches for proper positioning of the detent blocks.

2 Claims, 6 Drawing Sheets

RATCHET WRENCH

TECHNICAL FIELD OF THE INVENTION

The present invention generally relates to a ratchet wrench, and particularly to a ratchet wrench that contains simplified parts but is effectively in change of rotational direction.

DESCRIPTION OF THE PRIOR ART

A conventional ratchet wrench, designated at 1, is illustrated in FIG. 1 of the attached drawings, and generally comprises a body 11, a ratchet wheel mounted inside an end of the body 11, a detent block 13, and a switching member 14. The detent block 13 is engageable with the ratchet wheel 12, and the switching member 14 is in operative coupling with the detent block 13. An end 121 of the ratchet wheel 12 extends outside the end of the body 11 to rotatably couple to a control knob 16 through a retainer 15. The control knob 16 is in operative coupling with the switching member 14 for controlling the switching member 14 to rotate the detent block 13 so as to effect direction change of the rotation of the ratchet wrench 1.

The above described construction of the conventional ratchet wrench 1 is effective in realizing direction change, but is comprised of numerous parts, which needs elaborate and complicated handling and machining, making the expense for manufacturing and assembling very high and thus lowering market competitivity. In addition, since the wrench is composed numerous parts, the wrench becomes bulky and heavy, making the use thereof difficult and inconvenient.

Further, since the control knob 16 is rotatably coupled to an end 121 of the ratchet wheel 12, to prevent the control knob 16 from being undesired moved due to the rotation of the ratchet wheel 12, a sophisticated retention device 17 must be arranged to ensure proper positioning of the control knob 16, and further, the control knob 16 must be elaborately structured in order to maintain good rotatable coupling with the ratchet wheel 12. This certainly increases the manufacturing expense. Further, since the working environments for the ratchet wrench may be unorganized and dirty, often leading to dirt or contaminants entering and hiding in the coupling between the control knob 16 and the ratchet wheel 12. This may deteriorate the coupling engagement between the control knob 16 and the ratchet wheel 12 and leads to improper operation of direction change in the use of the wrench. In addition, the conventional ratchet wrench 1 is not equipped with means for reciprocation of the detent block 13 and teeth formed on the detent block 13 may easily get jammed with teeth of the ratchet wheel 12, leading to incapability of rotation in reversed direction.

In view of the above drawbacks of the conventional ratchet wrench 1, the present invention aims to provide a ratchet wrench featuring simplification of parts but still maintaining proper operability of change of rotational direction.

SUMMARY OF THE INVENTION

The primary technical solution of the present invention is to provide a ratchet wrench, which comprises at least a body, a ratchet wheel, a control unit, and a rotary knob. The body has an end forming a ratchet wheel bore and a receiving hole, which respectively and rotatably receive the ratchet wheel and the rotary knob therein. A channel is defined in the body between the ratchet wheel bore and the receiving hole for receiving therein the control unit. The control unit includes two detent blocks and a spring. The detent blocks are biased by the spring to be alternately engageable with teeth formed in the ratchet wheel. The rotary knob retains a control bar and a positioning ball. The receiving hole has an inner circumferential wall in which two positioning notches are defined. The control bar is operated to selectively move the detent blocks to desired positions and the positioning ball is biased by a spring into selective engagement with a corresponding one of the positioning notches for proper positioning of the detent blocks. As such, the detent blocks can be properly positioned and convenience of use can be realized.

The secondary technical solution of the present invention is to provide a ratchet wrench, which comprises at least a body, a ratchet wheel, a control unit, and a rotary knob. The body has an end forming a ratchet wheel bore and a receiving hole, which respectively and rotatably receive the ratchet wheel and the rotary knob therein. The rotary knob forms rough knurled pattern by which an increased frictional force is provided for a user's operation of rotation and thus convenience of rotation of the rotary knob is realized.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention will now be explained with reference to the drawings.

Figure 1:
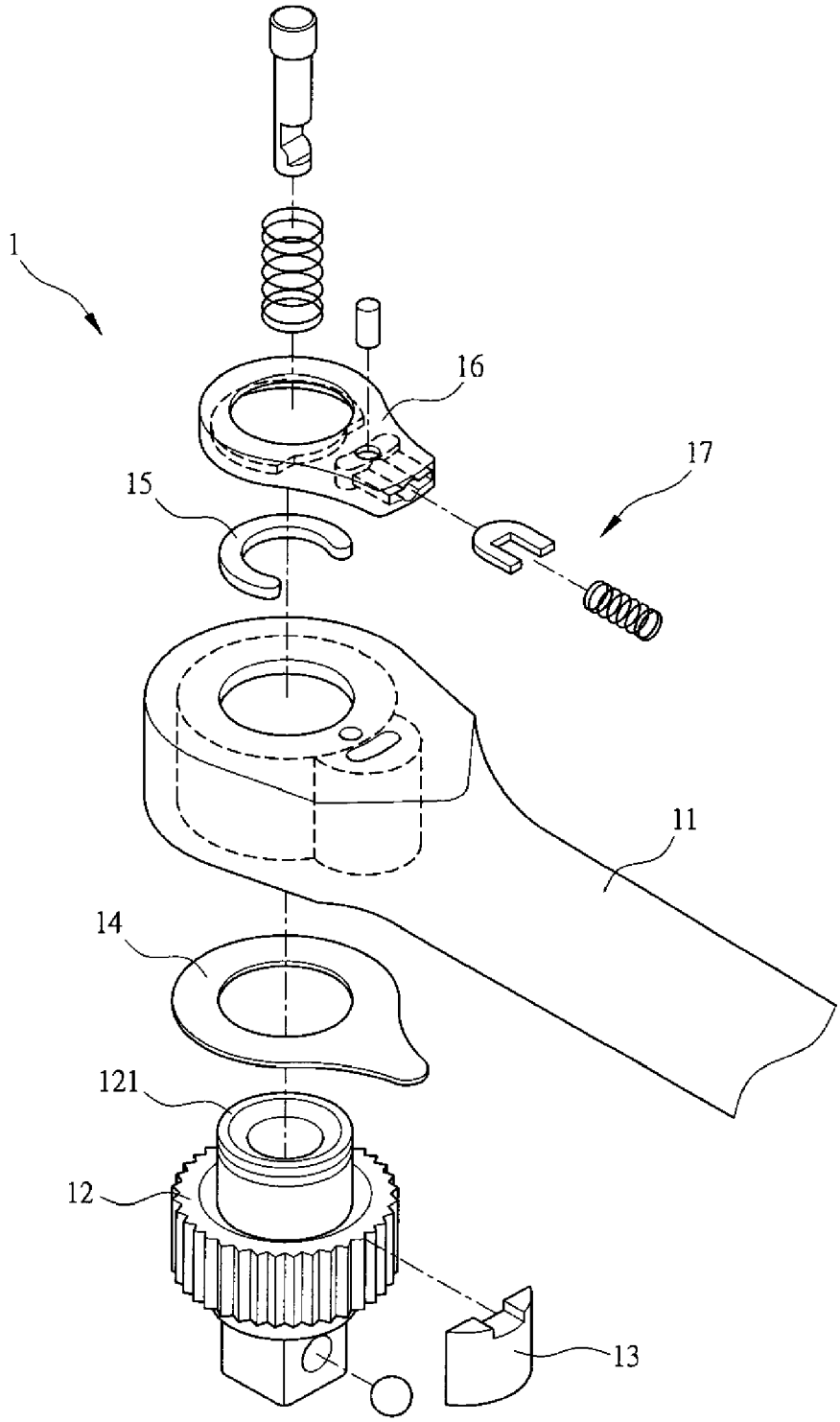
PRIOR ART FIG.1
FIG. 1 is an exploded view of a conventional ratchet wrench.
Figure 2:
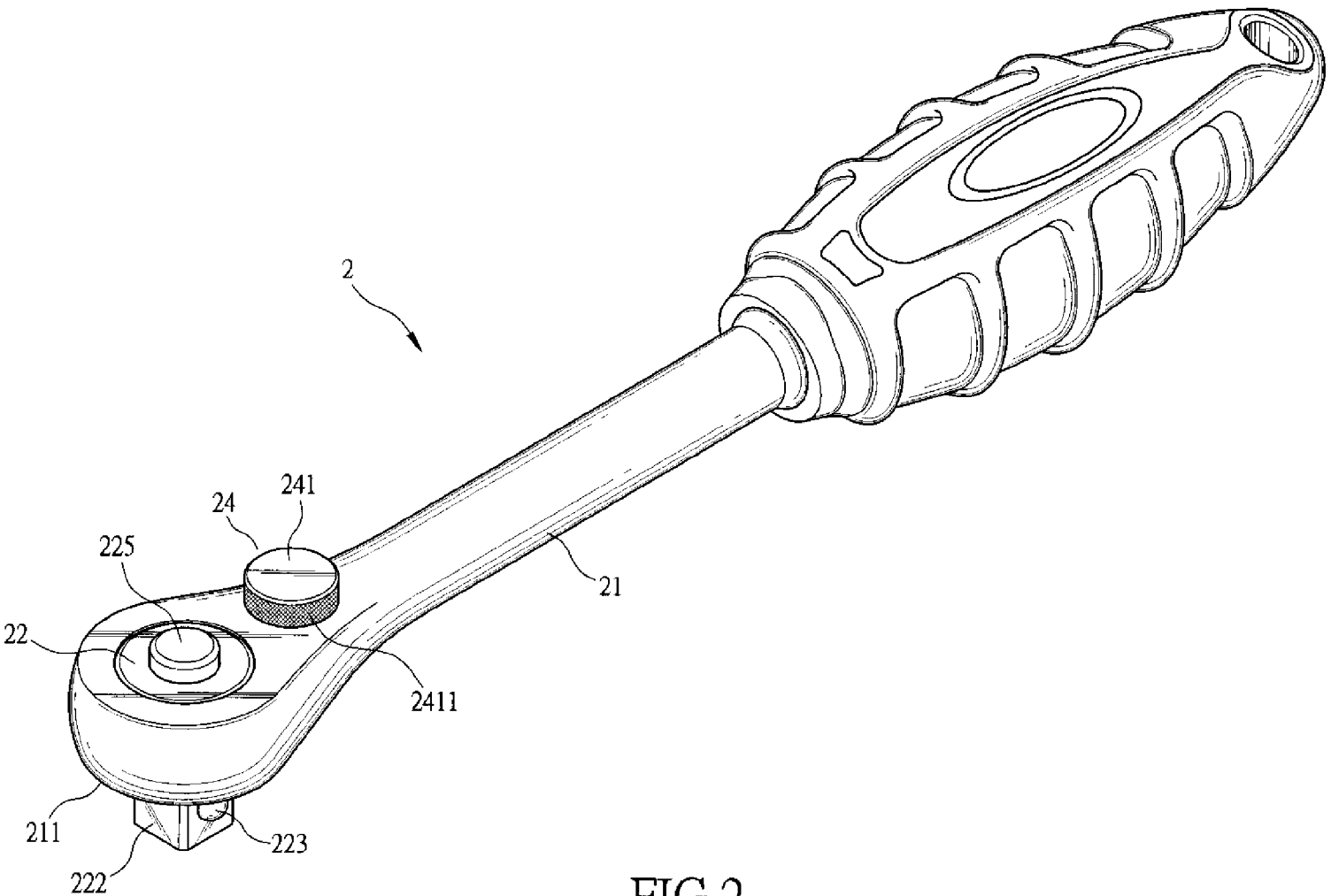
FIG. 2 is a perspective view of a ratchet wrench in accordance with the present invention.
Figure 3:
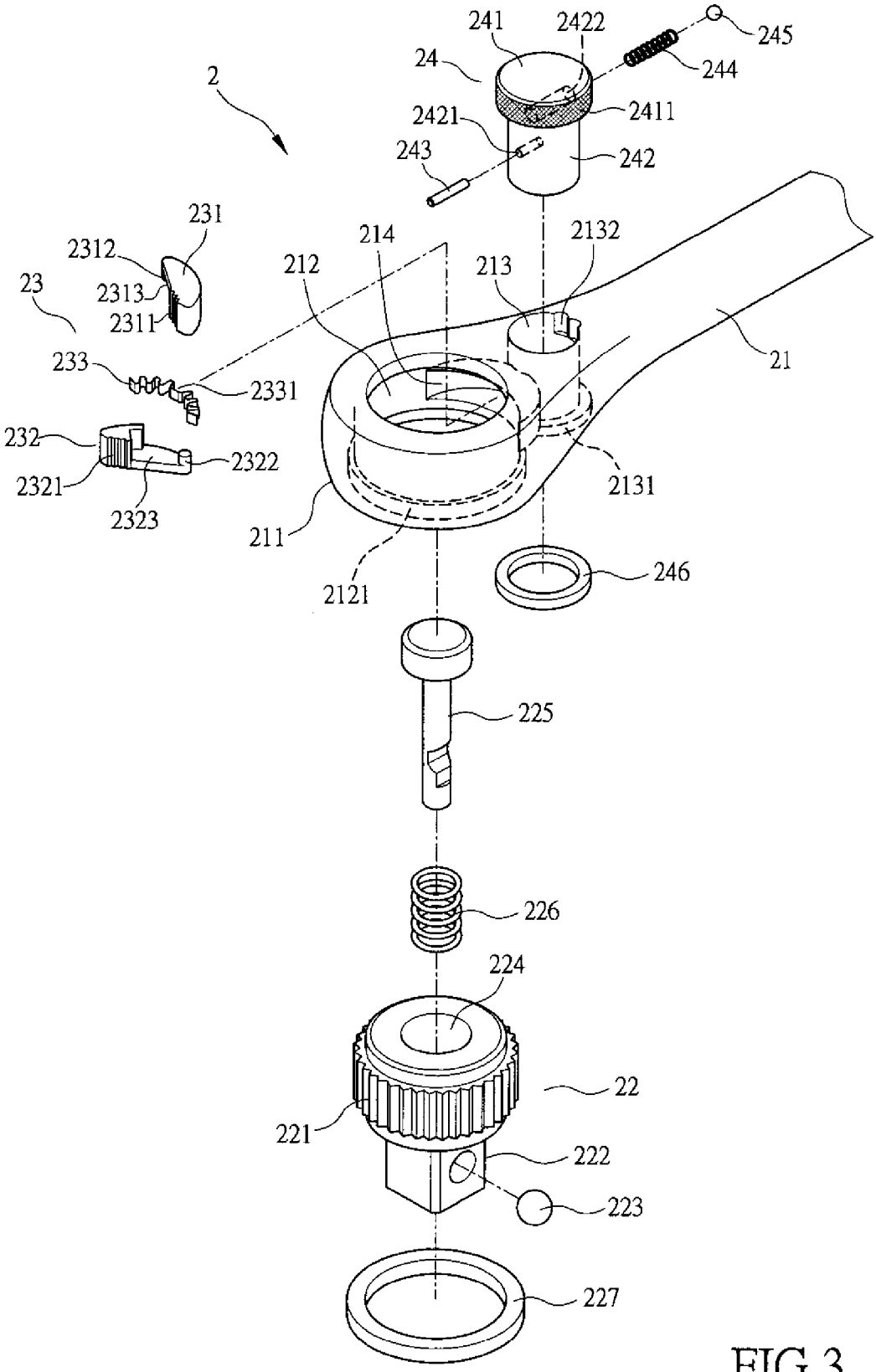
FIG. 3 is an exploded view of the ratchet wrench in accordance with the present invention.

Initial reference is made to FIGS. 2 and 3. The present invention provides a ratchet wrench 2, which comprises at least a body 21, a ratchet wheel 22, a control unit 23, and a rotary knob 24.

The body 21 has an end 211 forming a ratchet wheel bore 212 and a receiving hole 213, both extending therethrough. Bottom parts of the ratchet wheel bore 212 and the receiving hole 213 each form an expanded opening 2121, 2131. A channel 214 is defined in the body 21 between the ratchet wheel bore 212 and the receiving hole 213. The receiving hole 213 has a circunmferential inner wall forming two positioning notches 2132.

The ratchet wheel 22 is received in the ratchet wheel bore 212 of the body 21. The ratchet wheel 22 has an upper portion forming circumferentially teeth 221 and a lower portion forming a working end 222. The working end 222 comprises a steel ball 223 movably embedded therein. The ratchet wheel 22 forms, in a central portion thereof, a through hole 224 in which a push button 225 and a spring 226 are received. The ratchet wheel 22 is provided with a positioner ring 227 at the lower portion thereof and the positioner ring 227 is tightly fit into the expanded opening 2121 of the body 21 to position and retain the ratchet wheel 22 in the ratchet wheel bore 212.

The control unit 23 comprises two detent blocks 231, 232 and a spring 233. Each detent block 231, 232 forms at one end thereof a toothed face 2311, 2321 engageable with the teeth 221 of the ratchet wheel 22. Each detent block 231,232 forms a peg 2312, 2322 at an opposite end thereof. A receiving space 2313, 2323 is formed between the toothed face 2311, 2321 and the peg 2312, 2322 of each detent block 231,232. The detent blocks 231, 232 are structured and arranged to mutually fit to and mate each other and the spring 233 is received in the receiving spaces 2313, 2323 and is thus set between the two detent blocks 231, 232. The spring 233 comprises a corrugated plate formed in a fan shape. The spring 233 provides an outward-directing resiliency due to the corrugated configuration thereof in order to maintain an outward expanded condition of the detent blocks 231, 232. Further, the spring 233 comprises a flat section 2331 at a middle portion thereof and the flat section 2331 corresponds in position to the channel 214 formed in the end 211 of the body 21.

The rotary knob 24 has an upper portion forming an expanded, diameter-increased head 241 having a circumferential surface that forms knurling 2411. A stem 242 extends downward below the head 241. The stem 242 forms two deep holes 2421, 2422. The deep hole 2421 receives therein a control bar 243, which is of such a length that is partially exposed outside the stem 242 after being fully inserted into the hole 2421. The hole 2422 receives therein a spring 244 and a positioning ball 245, which corresponds in position to the positioning notches 2132 of the body 21. The rotary knob 24 is provided with a positioner ring 246 at a lower portion thereof and the positioner ring 246 is tightly fit into the expanded opening 2131 of the body 21 in order to position and retain the rotary knob 24 in the receiving hole 213 of the body 21.

Figure 4:
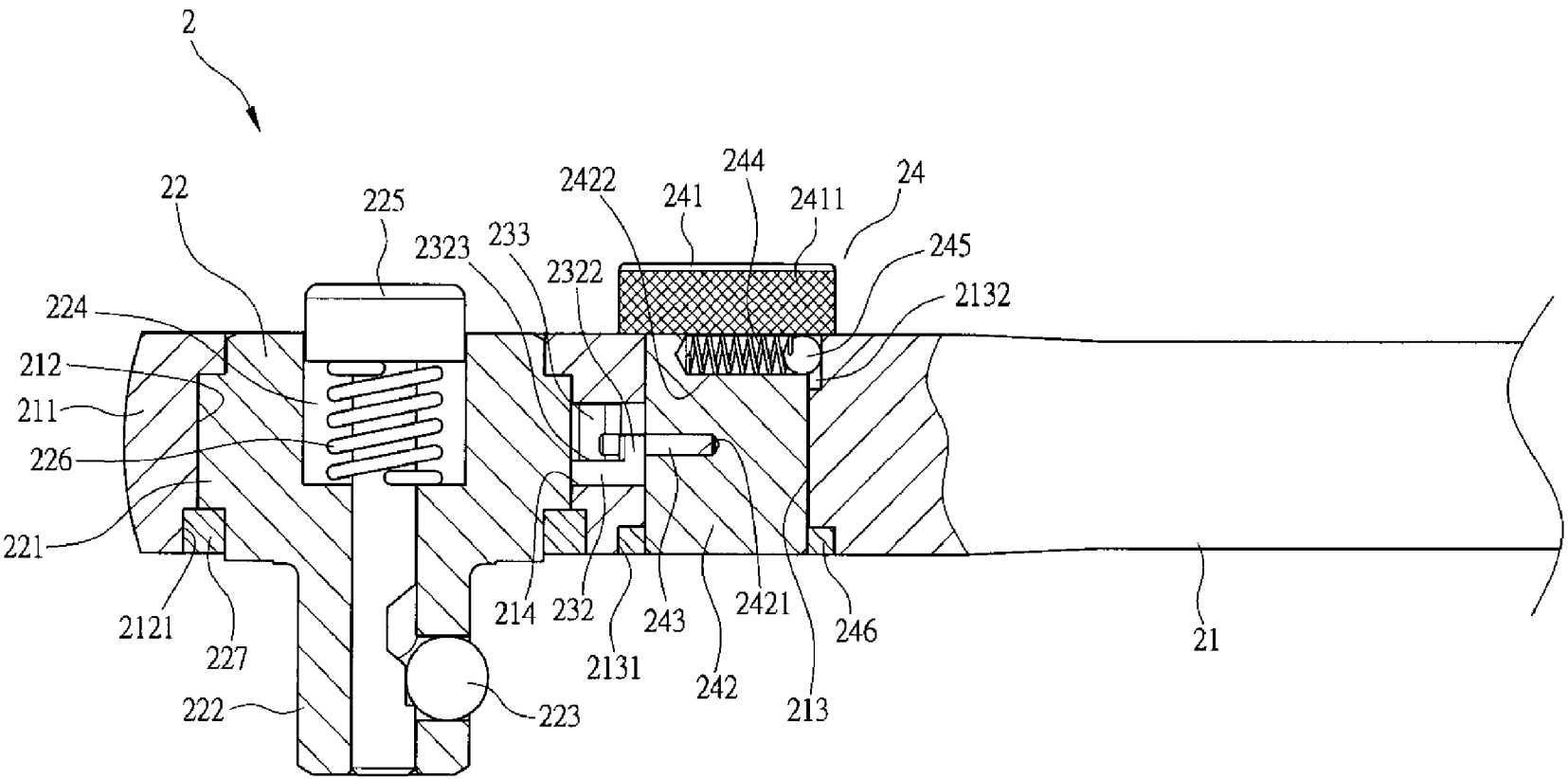
FIG. 4 is a cross-sectional view of the ratchet wrench in accordance with the present invention.

Referring to FIG. 4, to practice the present invention, the spring 244 and the positioning ball 245 of the rotary knob 24 are positioned into the deep hole 2422 of the stem 242. The stem 242 of the rotary knob 24 is then fit into the receiving hole 213 of the body 21. The control bar 243 is moved through the channel 214 to fit into the deep hole 2421 of the stem 242 of the rotary knob 24. Thereafter, the positioner ring 246 is tightly fit into the expanded opening 2131 of the receiving hole 213. Afterwards, the two detent blocks 231, 232 of the control unit 23 are fit to each other in a vertical direction and the spring 233 is set in the receiving spaces 2313, 2323 of the detent blocks 231, 232, which are then all put into the channel 214 of the body 21, whereby the control bar 243 is located between the pegs 2311 of the two detent blocks 231 and the flat section 2331 of the spring 233. The flat section 2331 of the spring 233 provides a space for accommodation of the control bar 243 in order to prevent interference between the control bar 243 and the corrugation of the spring 233. Finally, the push button 225 and the spring 226 are put into the through hole 224 of the ratchet wheel 22 and the ratchet wheel 22 is put into and retained in the ratchet wheel bore 212 of the body 21 by tightly fitting the positioner ring 227 into the expanded opening 2121 of the ratchet wheel bore 212. This completes the assembling of the ratchet wrench.

Figure 5:
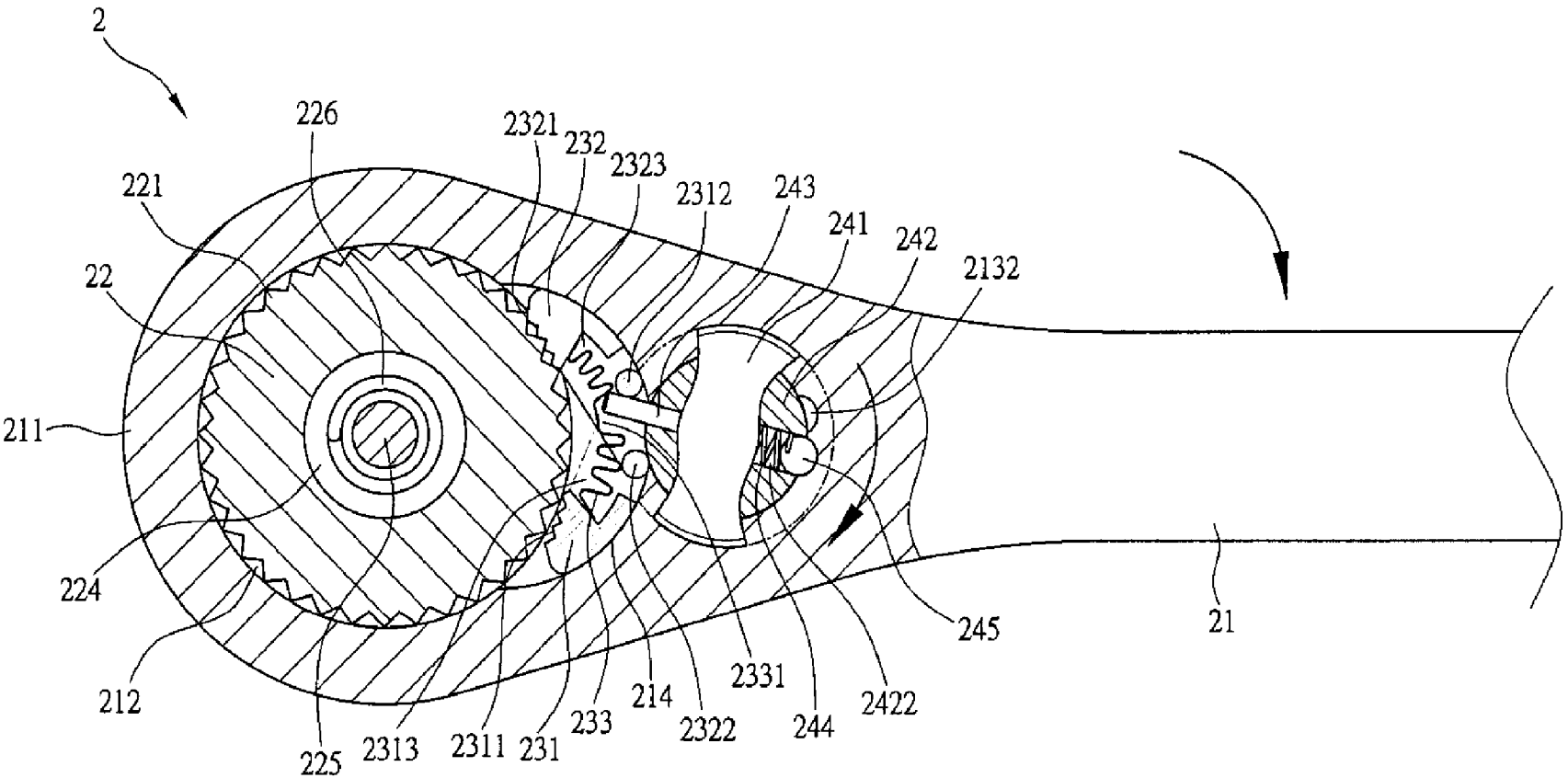
FIGS. 5 and 6 schematically illustrate direction change operation of the ratchet wrench in accordance with the present invention.

Referring to FIG. 5, to operate the present invention, the head 241 of the rotary knob 24 is rotated to make the control bar 243 driving the peg 2312 of the detent block 231 for inducing movement of the detent block 231, so that the toothed face 2311 is caused to disengage from the teeth 221 of the ratchet wheel 22. In addition, the spring 233 also applies a force to the other detent block 232 to make the toothed face 2321 of the detent block 232 engaging the teeth 221 of the ratchet wheel 22. The control bar 243 of the rotary knob 24 is properly set in position by the spring 244 biasing the positioning ball 245 into engagement with the corresponding positioning notch 2132, which also makes the rotary knob 24 properly set in position. Under this condition, the body 21 of the ratchet wrench 2 can make rotation in a first direction, such as clockwise direction.

Figure 6:
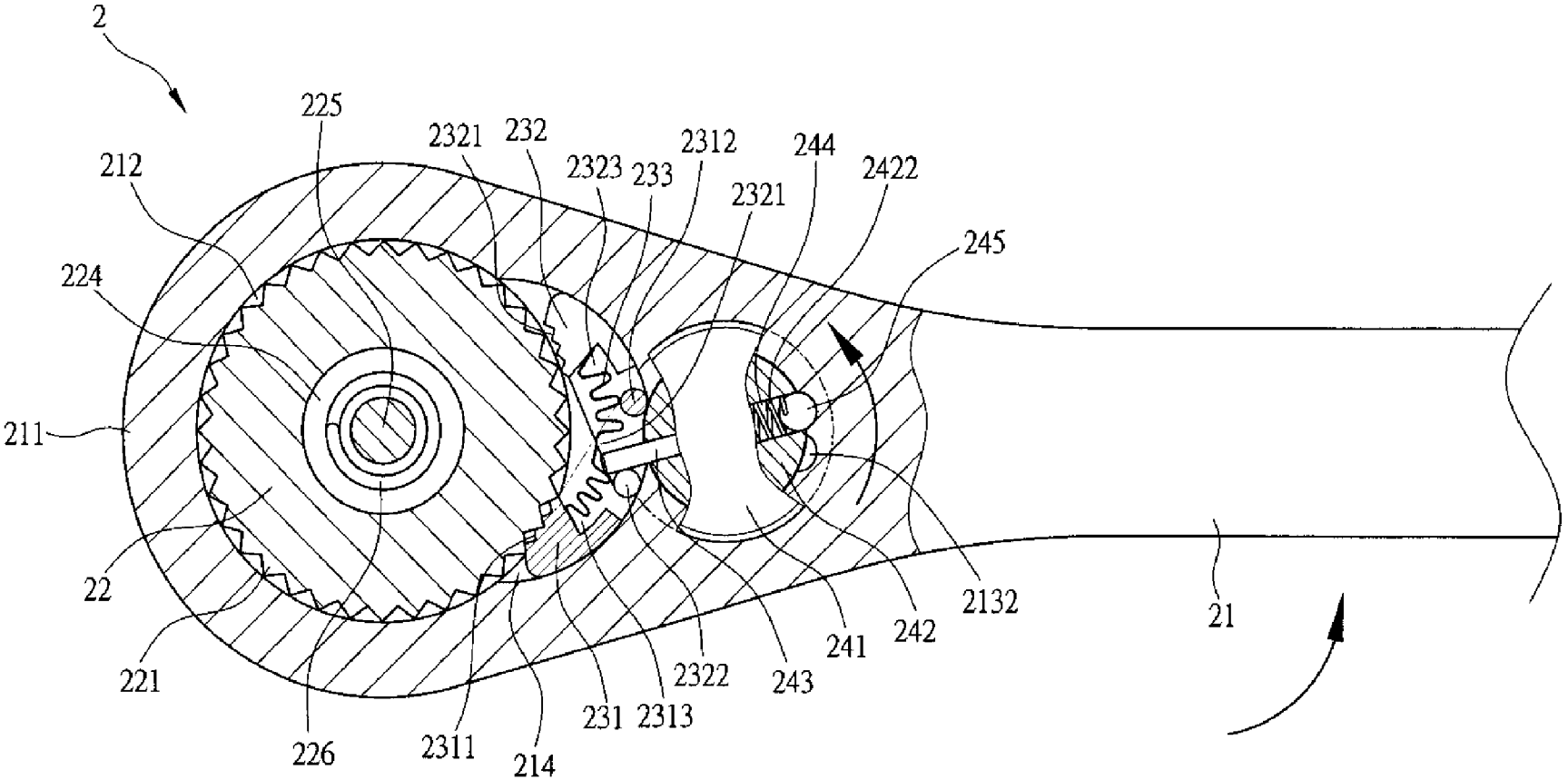

On the other hand, as shown in FIG. 6, to change the direction of rotation of the ratchet wheel 22, the rotary knob 24 is rotated to the opposite direction, making the control bar 243 driving the peg 2322 of the detent block 232 for inducing movement of the detent block 232, so that the toothed face 2321 disengages from the teeth 221 of the ratchet wheel 22. The spring 233 also applies a force, in an opposite manner, to the detent block 231 to make the toothed face 2311 of the detent block 231 engaging the teeth 221 of the ratchet wheel 22. The control bar 243 of the rotary knob 24 is properly set in position by the spring 244 biasing the positioning ball 245 into engagement with the corresponding positioning notch 2132, which also makes the rotary knob 24 properly set in position. Under this condition, the body 21 of the ratchet wrench 2 can make rotation in an opposite second direction, such as counterclockwise direction.

The effectiveness of the present invention is that by providing a channel 214 between the ratchet wheel bore 212 and the receiving hole 213 for completely accommodating therein the control unit 23, contaminants and other dirt are prevented from entering and being hiding in the control unit 23 to resist the operation of the detent blocks 231, 232 and the ratchet wheel 22. Further, by providing the control bar 243 and the positioning ball 245 in the rotary knob 24 and forming two positioning notches 2132 in an inner circumferential wall of the receiving hole 213, after the detent blocks 231, 232 are moved by the control bar 243, the detent blocks 231, 232 can be properly set in position by the spring 244 biasing the positioning ball 245 into engagement with the corresponding positioning notch 2132, so as to realize convenience of operation and use. Further, the head 241 of the rotary knob 24 is provided on the circumferential surface thereof, with knurling 2411, which provides an effective frictional force when being rotated by a user so as to realize easy rotation of the rotary knob 24.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ratchet wrench comprising:

a body having an end forming a ratchet wheel bore and a receiving hole both extending therethrough, bottom part of said ratchet wheel bore forming a first expanded opening; bottom part of said receiving hole forming a second expanded opening, a channel being defined in said body between said ratchet wheel bore and said receiving hole, said receiving hole having a circumferential inner wall forming two positioning notches;

a ratchet wheel received in said ratchet wheel bore, said ratchet wheel having an upper portion forming circumferentially teeth and a lower portion forming a working end, said ratchet wheel having a central portion provided with a through hole;

a steel ball movable embedded in said working end;

a first spring receiving said through hole of said ratchet wheel;

a push button put in said first spring and fitted in said through hole of said ratchet wheel;

a first positioner ring tightly fitted into said first expanded opening of said ratchet wheel bore to position and retain said ratchet wheel in said ratchet wheel bore;

a control unit comprising a first and a second detent blocks, said first detent block having an end provided with a first toothed face engageable with said teeth of said ratchet wheel and an opposite end provided with a first peg forming a first receiving space, said second detent block having an end provided with a second toothed face engageable with said teeth of said ratchet wheel and an opposite end provided with a second peg forming a second receiving space, said detent blocks being structured and arranged to mutually fit to and mate each other;

a rotary knob having an upper portion forming an expanded, diameter-increased head and a stem extending downward below said head and having a first hole and a second hole;

a control bar inserted into said first hole of said rotary knob and having a length partially exposed outside said stem;

a second spring received in said receiving spaces of said detent blocks and set between said detent blocks, said spring comprising a corrugated plate formed in a fan shape, said second spring providing an outward-directing resiliency due to said corrugated configuration in order to maintain an outward expanded condition of said detent blocks, said second spring having a middle portion provided with a flat section which corresponds in position to said channel for receiving an outer end of said control bar thereby preventing interference between said control bar and said corrugated configuration of said second spring;

a third spring received in said second hole of said rotary knob;

a positioning ball fitted in said second hole of said rotary knob and pushed by said third spring; and a second positioner ring tightly fitted into said second expanded opening of said body in order to position and retain said rotary knob in said receiving hole of said body;

wherein when said rotary knob is rotated to make said control bar driving said first peg of said first detent block for inducing movement of said first detent block and pushing said second spring towards said second detent block, so that said first toothed face of said first detent block is disengaged from said teeth of said ratchet and pressure of said second spring applied on said first detent block is alleviated, and said second spring is caused to apply more pressure on said second detent block to make said second toothed face of said second detent block engage said teeth of said ratchet wheel, thereby enabling said body to make rotation in a first direction; when said rotary knob is rotated to make said control bar driving said second peg of said second detent block for inducing movement of said second detent block and pushing said second spring towards said first detent block, so that said second toothed face of said second detent block is disengaged from said teeth of said ratchet and pressure of said second spring applied on said second detent block is alleviated, and said second spring is caused to apply more pressure on said first detent block to make said first toothed face of said first detent block engage said teeth of said ratchet wheel, thereby enabling said body to make rotation in an opposite second direction.

2. The ratchet wrench as claimed in claim 1, wherein said expanded head of said rotary knob comprises knurling.

* * * * *